United States Patent [19]

Fagan

[11] 4,031,283

[45] June 21, 1977

[54] POLYTETRAFLUOROETHYLENE FELT

[75] Inventor: Joseph P. Fagan, Huntington, Conn.

[73] Assignee: E. I. Du Pont de Nemours and Company, Wilmington, Del.

[22] Filed: Mar. 23, 1976

[21] Appl. No.: 669,602

Related U.S. Application Data

[63] Continuation-in-part of Ser. No. 633,837, Nov. 20, 1975, abandoned.

[52] U.S. Cl. ..... 428/280; 55/DIG. 16; 55/527; 264/127; 264/147; 264/288; 428/282; 428/300; 428/421

[51] Int. Cl.[2] ..... D04H 1/44

[58] Field of Search ..... 55/528, 527, DIG. 16; 428/280, 282, 287, 300, 421, 422; 264/147, 127, 288

[56] References Cited

UNITED STATES PATENTS

| | | | |
|---|---|---|---|
| 2,910,763 | 11/1959 | Lauterbach | 428/300 |
| 2,933,154 | 4/1960 | Lauterbach | 55/97 |
| 3,417,552 | 12/1968 | Dyer et al. | 55/528 |
| 3,664,915 | 5/1972 | Gore | 264/127 |

*Primary Examiner*—James J. Bell

[57] ABSTRACT

An improved felt-like material made from filamentary polytetrafluoroethylene (PTFE) is provided. The improvement is the presence of fibrils of PTFE criss-crossing interstices of the felt. These improved felt-like materials have a higher air porosity, while maintaining as high a filtering efficiency, than the currently-used felt-like materials.

4 Claims, No Drawings

POLYTETRAFLUOROETHYLENE FELT

RELATIONSHIP TO OTHER APPLICATIONS

This application is a continuation-in-part of application Ser. No. 633,837, filed Nov. 20, 1975 now abandoned.

BACKGROUND OF THE INVENTION

1. Field of the Invention

The invention relates to non-woven felt-like products comprised of filamentary polytetrafluoroethylene (PTFE). More particularly, it relates to an improvement in said felt-like products. The improvement is the presence of fibrils of PTFE which criss-cross interstices of the felt-like products.

2. Prior Art

Felts (i.e., non-woven unbonded fibrous structures deriving coherence and strength from interfiber entanglement and accompanying frictional forces) represent the oldest form of textile fabric. Animal fibers, such as wool and, to a degree, fur, are accepted as the only true feltable fibers. Forming them into felts requires preliminary compaction or "hardening" followed by additional working with addition of heat and usually moisture.

Felting of other filamentary materials has only been possible for a relatively short time, and felt-like products composed of them have only been available for a short time. U.S. Pat. No. 2,910,763, granted Nov. 3, 1959, to Herbert G. Lauterbach, discloses these felt-like products and processes for their preparation.

Since Lauterbach's discovery, felt-like products of PTFE have become a common commercial product for a variety of uses, for example, filtration and padding.

When the currently-used felt-like products are used in filtration, a balance between porosity and efficiency must be struck. High porosity of a felt-like product usually indicates that interstices are large. The higher the porosity of currently-used felt-like product, the less efficient it is as a filter because particles will be able to pass through the interstices of the felt.

However, high porosity is desirable because it produces a higher air/cloth ratio capability and causes a low pressure drop across the felt-like product.

These properties will result in longer filtration cycles between cleaning, less energy required for filtration, and longer life of the filter.

However, the high efficiencies required for filtration (above 99% in order to meet standards promulgated by governmental agencies) severely limit the porosity levels useful.

The product of this invention is a felt-like product of PTFE having significantly increased porosity that, when used as a filter, maintains an efficiency of above 95%, preferably above 99%.

SUMMARY OF THE INVENTION

A felt-like article comprised of filamentary polytetrafluoroethylene characterized by predominantly horizontal coplanar superimposed layers of filamentary polytetrafluoroethylene components interrupted by occasional interlayered orientation, and by fibrils of polytetrafluoroethylene criss-crossing interstices of the felt-like article is provided.

DESCRIPTION OF THE INVENTION

The technology for the production of a felt-like product, while relatively new, is now well known in the art. U.S. Pat. No. 2,910,763, granted Nov. 3, 1959 to Herbert G. Lauterbach, is an early disclosure of this technology. The disclosure of the Lauterbach reference is hereby incorporated by reference.

The Lauterbach patent discloses the formation of synthetic filamentary material into non-woven felt-like products (hereinafter "felt"). This is accomplished by forming filamentary material, at least the preponderant part of the material being retractable and of synthetic composition, into a loose batt as a plurality of superimposed substantially horizontal parallel layers, the filamentary material lying essentially coplanar on each layer, forcibly orienting some of the filamentary material from each layer into a substantial parallelism with one another and into at least one adjacent layer at occasional intervals distributed throughout the batt, and then compacting the batt by exposure to treatment effective to retract the retractable component without fusing the fibers.

Lauterbach discloses that polytetrafluoroethylene (PTFE) is useable as a material for making felt.

The felt of this invention is produced from PTFE filament. The filaments can be any commercially available PTFE filament in the full range of denier. To obtain a felt which is the most commercially acceptable, a denier range of 2–10 is preferred, a range of 5–9 is more preferred, and a range of 6–7 is even more preferred.

PTFE filaments are produced by various methods, including slitting PTFE film into thin structures and then expanding and orienting these structures as shown in Gore, U.S. Pat. No. 3,664,915, issued May 23, 1972; or by blending viscous with a PTFE dispersion, and then extruding the filament and removing the viscous. This extruded filament is dark brown; however, it can be bleached, if desired, by various techniques, for example, passing it through a nitric acid bath or baking it at high temperatures. The extruded PTFE filament is preferred for use in the invention.

As the Lauterbach reference discloses, there are many nuances allowable in processes for forming felt; however, the last step of any process is compacting, i.e., retraction or condensation. Compacting may result from a simple reduction in length (i.e., shriveling) or from a distortion of the filament into an irregular shape (i.e., crimping or curing) or both.

The felt of this invention is preferably compacted by placing a roll of uncompacted PTFE felt onto a tenter frame and passing the felt through an oven. A tenter frame is a device commonly known by those skilled in the art. The tenter frame allows the edges of the felt to be attached to it by various means, for example, pins, to provide support to the felt during compacting, and to pull the felt through an oven.

The oven will have a means for heating the felt. The means can be air having a temperature of 450°–600° F, preferably 475°–525° F, and most preferable, about 490°–500° F.Preferably, air jets will be used to blow the hot air against both the upper and lower surfaces of the felt.

The felt will advance through the oven upon the tenter frame at a rate above 20 yards per minute, preferably 25–40, and more preferably about 28–32 yards per minute.

The dwell time for each pass within the oven should be above 2 minutes, and preferably about 2.5 minutes.

The felt will have more than two changes of direction within the oven. The angle of the change of direction can vary from about 45° to about 240°, preferably, 135°–235°, more preferably 160°–200°. It is preferable to have at least 6 changes of direction. Rollers can be used to change the direction of the felt. Preferred rollers have a diameter greater than about 12 inches, more preferably, between about 16–20 inches. The felt preferably will undergo more than one pass in the oven.

The felt of the present invention, which can be prepared as suggested above, when compared with the currently commercially available felts, has as high a filtration efficiency while having higher porosity.

When a felt has higher porosity, there is a decreased pressure drop across the felt when it is used as a filter. Pressure drop is the difference between the pressure on the side of the felt where a filtrate collects and the side of the felt from which the filtered medium escapes. Advantages which can be derived from this phenomenon are:

1. allowance for higher dust loadings;
2. allowance for a longer filtration cycle between cleaning intervals;
3. lower power requirement;
4. allowance for higher air-to-cloth ratio (filter ratio); and
5. prevention of premature blinding at proper filter ratio. All of these eventually result in a lower cost per performance ratio.

To determine efficiency or particle arrestance, the Gravimetric Method is used. In this test, known amounts of test dust are fed incrementally at a reasonably controlled rate using compressed air regulated through a pressure valve and solenoid switch. Efficiency is determined by positioning a pre-weighed "absolute" filter (pore size = 0.8 micron) downstream of the test specimen. The weight gained by the "absolute" filter after each increment of dust fed constitutes the amount of dust penetrated through the test specimen.

The test uses a scale-down wind tunnel and has the following parameters:

| | | |
|---|---|---|
| Filler Ratio | — | 10 cubic feet per minute (CFM) per square foot |
| Test Dust | — | AC Fine Dust (laboratory simulation of atmospheric dust). AC Fine Dust is classified from natural Arizona road dust. It is essentially a mixture of $SiO_2$, $FeO_2$, $Al_2O_3$, CaO, MgO, and alkalis with the following particle size distribution: |
| | Size Range (Microns) | Percent by weight |
| | 0–5 | 39 ± 2% |
| | 5–10 | 18 ± 3% |
| | 10–20 | 16 ± 3% |
| | 20–40 | 18 ± 3% |
| | 40–80 | 9 ± 3% |
| Incremental Dust Fed | 5 grams | |
| Test Area | 6" ×6" | ~ 0.25 per square foot |
| Air Volumetric Flow Rate | | ≃ 2.5 CFM (at 70° F) |
| Approximate Feeding Time per Increment | | ≃ 60 minutes |
| Approximate Dust Loading | | ≃ $\frac{0.513 \text{ gram}}{\text{cubic foot}}$ |

The porosity of the felt is determined by the Standard Method of Test for Air Permeability of Textile Fabrics, ASTM-D-737-69, also known as the Frazier Air Porosity Test.

Air porosity or air permeability is the rate of air flow through a material under a differential pressure between the two fabric surfaces. Air porosity is expressed in U.S. customary units as cubic feet of air per minute per square foot (CFM) of fabric at a stated pressure differential between the two surfaces of the fabric.

The filter made from the felt of this invention has an efficiency greater than 95%, preferably 97, more preferably 99, and even more preferably 99.75.

The felts have high efficiency while having an air porosity, measured at 0.5-inch W.G., of greater than 35 CFM, preferably greater than 45 CFM, and more preferably above 50 CFM.

The reason the felts of this invention have high efficiency while having higher air porosity is seen when the felt is viewed through an electron microscope.

The interstices of the felt are criss-crossed by fibrils of PTFE.

Interstices are unfilled gaps or intervals in a fabric. The borders of an interstice are defined by the PTFE staple which makes up the felt.

The fibrils of PTFE are microfilaments of PTFE which are formed by splitting from the staple during the condensing process.

The criss-crossing of the interstice provides a "spider web" type of construction which can "catch" the dust particles while allowing air to pass through it.

The following Example Felts and Comparison Felts will disclose the difference between the felt of this invention and the felt currently known.

EXAMPLES AND COMPARISONS

Rolls of polytetrafluoroethylene (PTFE) felt and prepared as follows:

Extruded PTFE filaments having 6.67 denier are skeined and cut into 4.5-inch staple. The staple is garnetted to comb and orient the staple.

The combed staple is deposited and cross-lapped onto a PTFE scrim. A scrim is used to provide additional support to the felt.

The scrim is a PTFE fabric weighing 1.07 pounds/yard length/77 inches wide. The one-side-coated scrim is lightly needled to facilitate handling.

The one-side-coated scrim is turned over, and combed staple is deposited and cross-lapped onto the second side of the scrim to form a batt.

The batt is passed through a needle loom with regular barbed needles to punch a number of staple into and through the batt in the direction of its thickness, i.e., substantially perpendicular to the top and bottom surfaces. The needling action occurs about 1,000 times per square inch of batt surface. The needled batt is a felt. However, the felt is condensed, i.e., compacted, to provide further strength and higher density, and to increase its heat-stability.

The Example Felts are condensed in a different manner than Comparison Felts.

The rolls of felt for the Examples are condensed in a Kenyon Dryer sold by Kenyon Company. First, the felt is placed onto the tenter frame of the Kenyon Dryer. Then the felt, while on the tenter frame, travels through the oven of the Kenyon Dryer. The distance traveled on the tenter frame within the oven is 76 yards. The felt travels at a speed of 30 yards per minute and has a dwell time within of the oven of 2½ minutes.

While in the oven, the felt changes direction seven times by going round seven rollers, each having an 18-inch diameter. The angle of the change of direction is 180°.

The oven has hot air nozzles which blow hot air (at 500° F) directly onto the upper and lower surfaces of the felt. The nozzles are holes placed along the length of tubes and positioned to allow air passing through the holes to blow directly onto the felt. The tubes are placed on a parallel plane about 2–3 inches above and below the plane of the felt. Each tube's longitudinal axis is at a 90° angle to the felt's direction of travel.

Twenty tubes, equidistantly apart, are placed both above and below the plane traveled by the felt after the felt enters the oven and after each change of direction; therefore, within the Kenyon Dryer, there is a total of 320 tubes.

Each tube has 240 holes. Each tube passes 200 cubic feet of air per minute at a velocity of 600 linear feet per minute.

The rolls of felt are passed through the oven twice. During the two passes, the width of the roll has been reduced from the original 75 inches to 65 inches.

The Comparison Felts are condensed in a currently-used manner. The rolls of felt are placed onto a tenter frame. The felt, while on the tenter frame, travels 5 yards through an oven. The direction of the felt does not change; it goes straight through the oven at a speed of 1.33 yards per minute, and has a dwell time within the oven of approximately 4 minutes. The oven is set at 500° F. The width of the rolls of Comparison Felt has been reduced from 75 inches to 65 inches in one pass.

By unaided visual inspection, no differences in the felts prepared by the different condensement methods are noted. However, when the felts undergo testing or are seen through an electron microscope, important differences are noted.

When the Example Felts are viewed through an electron microscope, a random distribution of staple of PTFE is seen, and interstices are clearly defined by the staple of PTFE. However, there are, throughout the felt, fibrils of PTFE criss-crossing the interstices.

The relative size difference between the staple and the fibril is shown by the approximate diameter of the staple being 1 mil and the fibril being .01 mil.

When the Comparison Felts are viewed through an electron microscope, a random distribution of PTFE filaments are seen, and the interstices are clearly defined by the staple, but the felt is substantially free of fibrils.

As the Example and Comparison show, there are significant differences in the condensing of the felts. These differences, e.g., rate of speed and changes of direction, cause increased mechanical work upon the felt. It is thought that this increased mechanical work causes the fibrils to form.

The following is a summary of physical properties of the Example Felts and Comparison Felts.

| PROPERTY | | | COMPARISON FELTS | EXAMPLE FELTS |
|---|---|---|---|---|
| | A. Average<br>B. Range | | | |
| I. | Thickness In. 001-Inch | A. | 57.1 | 59.5 |
| | | B. | 49–65 | 48–71 |
| II. | Weight Oz. per Square Yard | A. | 25.7 | 25.1 |
| | | B. | 22.5 – 29 | 21.5 – 29 |
| III. | Frazier Air porosity at 0.5" W.G. (CFM per square foot) cubic feet per minute per square foot | A. | 33.5 | 53.7 |
| | | B. | 23–44 | 37–70.5 |
| IV. | Mullen Burst Pounds per square inch | A. | 367 | 353 |
| | | B. | 305 – 429 | 313 – 393 |
| V. | Efficiency % | A. | > 99.84 | > 99.83 |

As can be seen, the thickness, weight, Mullen Burst test result, and efficiency are similar. However, there is a statistically significant difference between the porosity of the Example Felts and the Comparison Felts. This difference makes a filter made from the Example Felt have higher air/cloth ratio capability, low pressure drop, require less energy for filtration, longer filtration cycles between cleaning, and longer useful life.

What is claimed is:

1. A felt-like article comprised of filamentary polytetrafluoroethylene characterized by
   a. predominantly horizontal coplanar superimposed layers of filamentary polytetrafluoroethylene components interrupted by occasional interlayered orientation, and
   b. fibrils of polytetrafluoroethylene criss-crossing interstices of the felt-like article;

Wherein the article has a filter efficiency greater than 95% and an air porosity, measured at 0.5 inch W.G., of greater than 45 cubic feet per minute.

2. A filter comprised of the felt-like article of claim 1.

3. A method of filtering characterized by the use of a filter comprised of the felt-like article of claim 1

4. A process for producing the felt-like article of claim 1, the process comprising
   a. forming filamentary polytetrafluoroethylene into a loose batt as a plurality of superimposed substantially horizontal parallel layers,
   b. forcibly orienting some of the filamentary polytetrafluoroethylene into substantial parallelism with one another and into at least one adjacent layer at occasional intervals distributed throughout the batt, and then
   c. compacting the batt by exposure to treatment effective to retract the filamentary polytetrafluoroethylene without fusing the fiber and to cause formation of fibrils criss-crossing interstices.

* * * * *